US011173707B2

(12) United States Patent
Watanabe et al.

(10) Patent No.: US 11,173,707 B2
(45) Date of Patent: Nov. 16, 2021

(54) DRIVING CIRCUIT, LIQUID EJECTING HEAD, AND LIQUID-EJECTING RECORDING APPARATUS

(71) Applicant: SII PRINTEK INC., Chiba (JP)

(72) Inventors: Toshiaki Watanabe, Chiba (JP); Kensuke Yoshida, Chiba (JP)

(73) Assignee: SII Printek Inc., Chiba (JP)

( * ) Notice: Subject to any disclaimer, the term of this patent is extended or adjusted under 35 U.S.C. 154(b) by 0 days.

(21) Appl. No.: 16/797,371

(22) Filed: Feb. 21, 2020

(65) Prior Publication Data

US 2020/0269569 A1 Aug. 27, 2020

(30) Foreign Application Priority Data

Feb. 27, 2019 (JP) ..... JP2019-033587

(51) Int. Cl.
*B41J 2/045* (2006.01)

(52) U.S. Cl.
CPC ..... *B41J 2/04541* (2013.01); *B41J 2/0457* (2013.01); *B41J 2/04555* (2013.01); *B41J 2/04588* (2013.01)

(58) Field of Classification Search
CPC ..... B41J 2/125; B41J 2/2142; B41J 2/16579
See application file for complete search history.

(56) References Cited

U.S. PATENT DOCUMENTS

2006/0007260 A1 1/2006 Oku
2010/0302302 A1* 12/2010 Kubo ..... B41J 2/125 347/19

FOREIGN PATENT DOCUMENTS

JP 2011-224799 A 11/2011
JP 2016-196092 A 11/2016
JP 2017-113942 A 6/2017

OTHER PUBLICATIONS

Extended European Search Report for Europe Application No. 20159720.0, dated Jul. 30, 2020, 9 pages.

* cited by examiner

*Primary Examiner* — Lam S Nguyen
(74) *Attorney, Agent, or Firm* — Crowell & Moring LLP

(57) ABSTRACT

An embodiment of the present disclosure is a driving circuit for ejecting liquid from a plurality of nozzles in an ejecting section in a liquid ejecting head. The driving circuit includes a first signal generation section that generates a printing driving signal for ejecting the liquid from the nozzles, a second signal generation section that generates an inspection driving signal for inspecting a state of the ejecting section, and a control section that controls the first signal generation section and the second signal generation section so as to exclusively output one of the printing driving signal and the inspection driving signal to the ejecting section.

4 Claims, 8 Drawing Sheets

COMPARATIVE EXAMPLE

DRIVING CIRCUIT, LIQUID EJECTING HEAD, AND LIQUID-EJECTING RECORDING APPARATUS

RELATED APPLICATIONS

This application claims priority to Japanese Patent Application No. 2019-033587 filed on Feb. 27, 2019, the entire content of which is incorporated herein by reference.

BACKGROUND OF THE INVENTION

1. Field of the Invention

The present disclosure relates to a driving circuit, a liquid ejecting head, and a liquid-ejecting recording apparatus.

2. Description of the Related Art

A liquid-ejecting recording apparatus including a liquid ejecting head is used in various fields, and various types of liquid ejecting heads have been developed (for example, JP2017-113942A).

SUMMARY OF THE INVENTION

In such a liquid ejecting head and a liquid-ejecting recording apparatus, or such a driving circuit applied to the liquid ejecting head, improvement of convenience is required.

It is desired to provide a driving circuit, a liquid ejecting head, and a liquid-ejecting recording apparatus, in which it is possible to improve convenience.

An embodiment of the present disclosure is a driving circuit for ejecting a liquid from a plurality of nozzles in an ejecting section in a liquid ejecting head. The driving circuit includes a first signal generation section that generates a printing driving signal for ejecting the liquid from the nozzles, a second signal generation section that generates an inspection driving signal for inspecting a state of the ejecting section, and a control section that controls the first signal generation section and the second signal generation section so as to exclusively output one of the printing driving signal and the inspection driving signal to the ejecting section.

According to another embodiment of the present disclosure, a liquid ejecting head includes the driving circuit according to the above-stated embodiment of the present disclosure and the ejecting section including the plurality of nozzles. The driving circuit drives the ejecting section based on the printing driving signal so as to eject the liquid from the nozzles, and drives the ejecting section based on the inspection driving signal in an inspection of the state of the ejecting section.

According to still another embodiment of the present disclosure, a liquid-ejecting recording apparatus includes the liquid ejecting head according to the above-stated embodiment of the present disclosure.

According to the driving circuit, the liquid ejecting head, and the liquid-ejecting recording apparatus according to the embodiment of the present disclosure, it is possible to improve the convenience.

DETAILED DESCRIPTION OF THE PREFERRED EMBODIMENTS

Hereinafter, an embodiment of the present disclosure will be described in detail with reference to the drawings. The description will be made in order as follows.

1. Embodiment (example of inspecting state of ejecting section liquid ejecting head)
2. Modification Example

1. Embodiment

A. Overall Configuration of Printer 1

Figure 1:
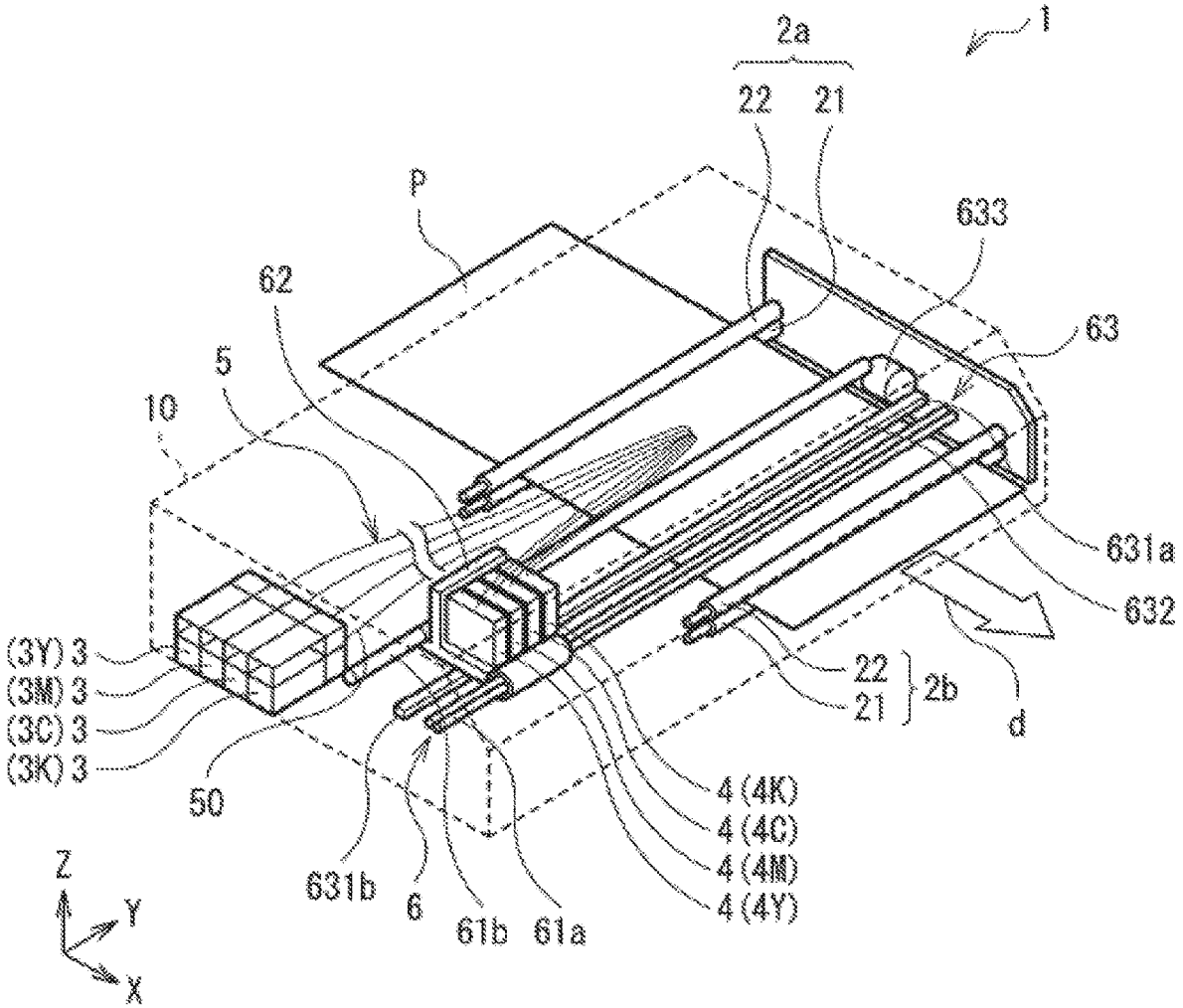
FIG. 1 is a schematic perspective view illustrating a schematic configuration example of a liquid-ejecting recording apparatus according to an embodiment of the present disclosure.

FIG. 1 is a perspective view schematically illustrating a schematic configuration example of a printer 1 as a liquid-ejecting recording apparatus according to an embodiment of the present disclosure. The printer 1 is an ink jet printer that performs recording (printing) of an image, characters, or the like on recording paper P as a recording medium with an ink 9 described later.

As illustrated in FIG. 1, the printer 1 includes a pair of transport mechanisms 2*a* and 2*b*, an ink tank 3, an ink jet head 4, an ink supply tube 50, and a scanning mechanism 6. The members are accommodated in a housing 10 having a predetermined shape. In the drawings used in the description of this specification, the scale of each member is appropriately changed in order to set the size of each member to be recognizable.

Here, the printer 1 corresponds to a specific example of "a liquid-ejecting recording apparatus" in present disclosure. The ink jet head 4 (ink jet heads 4Y, 4M, 4C, and 4K described later) corresponds to a specific example of "a liquid ejecting head" in the present disclosure. The ink 9 corresponds to a specific example of "a liquid" in the present disclosure.

As illustrated in FIG. 1, each of the transport mechanisms 2*a* and 2*b* is a mechanism that transports recording paper P in a transport direction d(X-axis direction). Each of the transport mechanisms 2*a* and 2*b* includes a grid roller 21, a pinch roller 22, and a driving mechanism (not illustrated). The driving mechanism rotates the grid roller 21 around the axis (rotates in a Z-X plane) and is configured by a motor and the like, for example.

Ink Tank 3

The ink tank 3 is a tank that accommodates the ink 9 therein. As the ink tank 3, in this example, as illustrated in FIG. 1, four types of tanks in which inks 9 having four colors being yellow (Y), magenta (M), cyan (C), and black (K) are respectively accommodated are provided. That is, an ink tank 3Y that accommodates a yellow ink 9, an ink tank 3M that accommodates a magenta ink 9, an ink tank 3C that accommodates a cyan ink 9, and an ink tank 3K that accommodates a black ink 9 are provided. The ink tanks 3Y, 3M, 3C, and 3K are arranged side by side in the housing 10 in the X-axis direction.

The ink tanks 3Y, 3M, 3C, and 3K have the same configuration except for the color of the ink 9 to be accommodated, and thus descriptions will be made in a state where the ink tanks 3Y, 3M, 3C, and 3K are collectively referred to as the ink tank 3 below.

Ink Jet Head 4

The ink jet head 4 is a head that ejects (discharges) ink droplets 9 onto recording paper P from a plurality of nozzles (nozzle holes Hn) described later, so as to perform recording (printing) of an image, characters, or the like. As the ink jet head 4, in this example, as illustrated in FIG. 1, four types of heads that ejects the four color inks 9 which are accommodated in the ink tanks 3Y, 3M, 3C, and 3K are provided, respectively. That is, an ink jet head 4Y that ejects the yellow ink 9, an ink jet head 4M that ejects the magenta ink 9, an ink jet head 4C that ejects the cyan ink 9, and an ink jet head 4K that ejects the black ink 9 are provided. The ink jet heads 4Y, 4M, 4C, and 4K are arranged side by side in the housing 10 in a Y-axis direction.

The ink jet heads 4Y, 4M, 4C, and 4K have the same configuration except for the color of the ink 9 to be used, and thus descriptions will be made in a state where the ink jet heads 41, 4M, 4C, and 4K are collectively referred to as the ink jet head 4 below. A detailed configuration example of the ink jet head 4 will be described later (FIGS. 2 to 5).

The ink supply tube 50 is a tube for supplying the ink 9 from the ink tank 3 into the ink jet head 4. The ink supply tube 50 is configured by a flexible hose, for example, having a flexibility allowing following of an operation of the scanning mechanism 6 described below.

Scanning Mechanism 6

The scanning mechanism 6 is a mechanism that performs scanning on the ink jet head 4 in a width direction (Y-axis direction) of recording paper P. As illustrated in FIG. 1, the scanning mechanism 6 includes a pair of guide rails 61*a* and 61*b* provided to extend in the Y-axis direction, a carriage 62 supported by the guide rails 61*a* and 61*b* to be movable, and a driving mechanism 63 that moves the carriage 62 in the Y-axis direction.

The driving mechanism 63 includes a pair of pulleys 631*a* and 631*b* disposed between the guide rails 61*a* and 61*b*, an endless belt 632 wound between the pulleys 631*a* and 631*b*, and a driving motor 633 that drives the pulley 631*a* to rotate. The four types of ink jet heads 4Y, 4M, 4C, and 4K described above are arranged side by side on the carriage 62 in the Y-axis direction.

A moving mechanism that relatively moves the ink jet head 4 and the recording paper P is configured by such a scanning mechanism 6 and the above-described transport mechanisms 2*a* and 2*b*.

B. Detailed Configuration of Ink Jet Head 4

A detailed configuration example of the ink jet head 4 will be described with reference to FIGS. 2 and 3.

Figure 2:
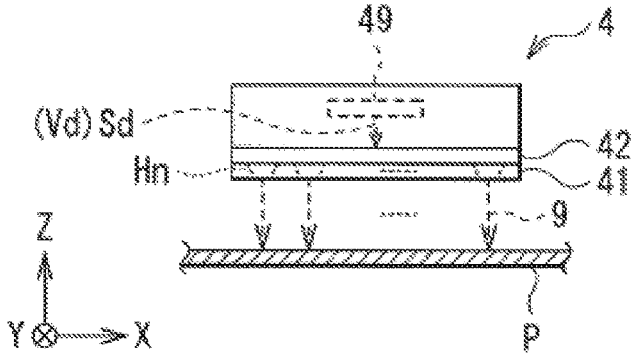
FIG. 2 is a schematic diagram illustrating the schematic configuration example of a liquid ejecting head illustrated in FIG. 1.

FIG. 2 schematically illustrates a schematic configuration example of the ink jet head 4. FIG. 3 is a block diagram illustrating the detailed configuration example of the ink jet head 4 illustrated in FIG. 2.

Figure 3:
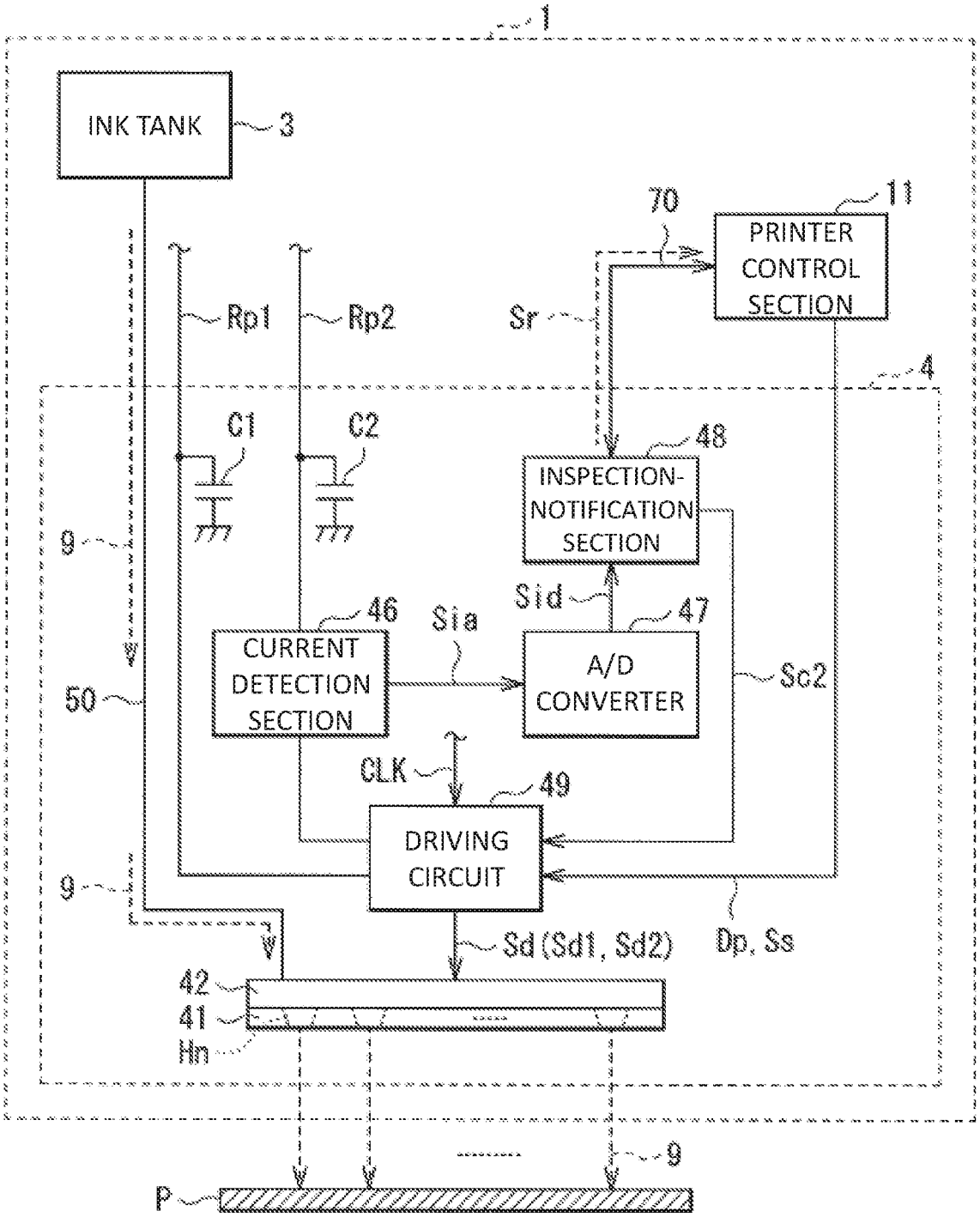
FIG. 3 is a block diagram illustrating a detailed configuration example of the liquid ejecting head illustrated in FIG. 2.

As illustrated in FIGS. 2 and 3, the ink jet head 4 includes a nozzle plate 41, an actuator plate 42, a current detection section 46, an A/D converter 47, an inspection-notification section (arithmetic operation section) 48, and a driving circuit (driving section) 49.

The nozzle plate 41 and the actuator plate 42 correspond to a specific example of "an ejecting section" in the present disclosure. The inspection-notification section 48 corresponds to a specific example of "an inspection section" and "a notification section" in the present disclosure.

Nozzle Plate 41

The nozzle plate 41 is a plate made of a film material such as polyimide or a metal material. As illustrated in FIGS. 2 and 3, the nozzle plate 41 includes a plurality of nozzle holes Hn that eject the ink 9 (see arrows of broken lines in FIGS. 2 and 3). The nozzle holes Hn are formed side by side at a predetermined interval in a straight line (in this example, in the X-axis direction). Each of the nozzle holes Hn corresponds to a specific example of "a nozzle" in the present disclosure.

Actuator Plate 42

The actuator plate 42 is a plate made of a piezoelectric material such as PZT (lead zirconate titanate), for example. A plurality of channels (not illustrated) are provided in the actuator plate 42. The channel is a portion functioning as a pressure chamber for applying pressure to the ink 9. The channels are arranged side by side to be parallel to each other at a predetermined interval. Each channel is formed by a drive wall (not illustrated) made of a piezoelectric material and has a recessed groove portion in a cross-sectional view.

A discharge channel for discharging the ink 9 and a dummy channel (non-discharge channel) for not discharging the ink 9 are provided in such channels. In other words, the discharge channel is filled with the ink 9, but the dummy channel is not filled with the ink 9. Each discharge channel communicates with the nozzle hole Hn in the nozzle plate 41, but each dummy channel does not communicate with the nozzle hole Hn. The discharge channel and the dummy channel are alternately arranged side by side in a predetermined direction.

A drive electrode (not illustrated) is provided on each of inner side surfaces facing each other of the drive wall. The driving electrode includes a common electrode provided on an inner side surface facing the discharge channel and an active electrode (individual electrode) on an inner side surface facing the dummy channel. The driving electrodes and a driving circuit in a drive substrate (not illustrated) are electrically connected to each other through a plurality of lead electrodes formed on a flexible substrate (not illustrated). Thus, a drive voltage Vd (driving signal Sd) described later is applied to each driving electrode from the driving circuit 49 described later through the flexible substrate.

Driving Circuit 49

The driving circuit 49 applies the drive voltage Vd (driving signal Sd) to the actuator plate 42 to expand or contract the discharge channel, and thus cause the actuator plate 42 to eject the ink 9 from each nozzle hole Hn (cause the actuator plate 42 to perform an ejection operation) (see FIGS. 2 and 3). That is, the driving circuit 49 drives the ejecting section (actuator plate 42 and nozzle plate 41) based on the printing driving signal Sd1 described later as the driving signal Sd, and thus the ink 9 is ejected from each nozzle hole Hn. The driving circuit 49 drives the ejecting section based on an inspection driving signal Sd2 described later as the driving signal Sd, in an inspection described later (inspection of the state of the ejecting section).

Here, the driving circuit 49 generates the printing driving signal Sd1 based on various types of data (signals) and the like transmitted from a printer control section 11 in the printer 1 (outside the ink jet head 4) (see FIG. 3). Specifically, the driving circuit 49 generates the printing driving signal Sd1 based on print data Dp and a discharge start signal Ss transmitted from the printer control section 11. The driving circuit 49 generates the inspection driving signal Sd2 with a method described later.

The printer control section 11 performs various controls for a printing operation on recording paper P. Such a driving circuit 49 is configured, for example, using an application specific integrated circuit (ASIC).

Here, in the example in FIG. 3, the print data Dp and the discharge start signal Ss are exemplified as data (transmission data) to be transmitted from the printer control section 11 outside the ink jet head 4 to the inside (driving circuit 49) of the ink jet head 4. Each of the print data. Dp and the discharge start signal Ss is transmitted by low voltage differential signaling (ENDS). In other words, the transmission data is data transmitted through a differential transmission path (high-speed differential transmission path). Thus, it is possible to perform high-speed transmission using a small amplitude signal, and the ability of removing common-mode noise is improved by using a differential transmission signal.

As illustrated in FIG. 3, two power supply paths Rp1 and Rp2 for supplying power from the outside of the ink jet head 4 are connected to the driving circuit 49. The power supply path Rp1 corresponds to a specific example of "a first power supply path" in the present disclosure. The power supply path Rp2 corresponds to a specific example of "a second power supply path" in the present disclosure.

The power supply path Rp1 is a power supply path used when the printing driving signal Sd1 is generated. As illustrated in FIG. 3, a bypass capacitor C1 is connected to the power supply path Rp1. The bypass capacitor C1 is provided to stably perform a printing operation (drive multiple pressure chambers described above during the printing operation) and is a large capacitance capacitor. The power supply path Rp1 is set to be wider than a conductor width thereof in order to correspond to a large drive current generated during the printing operation.

The power supply path Rp2 is a power supply path used when the inspection driving signal Sd2 described later is generated. As illustrated in FIG. 3, the power supply path Rp2 is electrically isolated from the power supply path Rp1 and is connected to a bypass capacitor C2. Differing from the printing operation, in an inspection described later, it is not required to drive the multiple pressure chambers, and the drive current is generated small (for example, about several of mA). Thus, the capacitance of the bypass capacitor C2 is smaller than the capacitance of the bypass capacitor C1. The conductor width of the power supply path Rp2 is set to be narrower than the conductor width of the power supply path Rp1.

Figure 4:
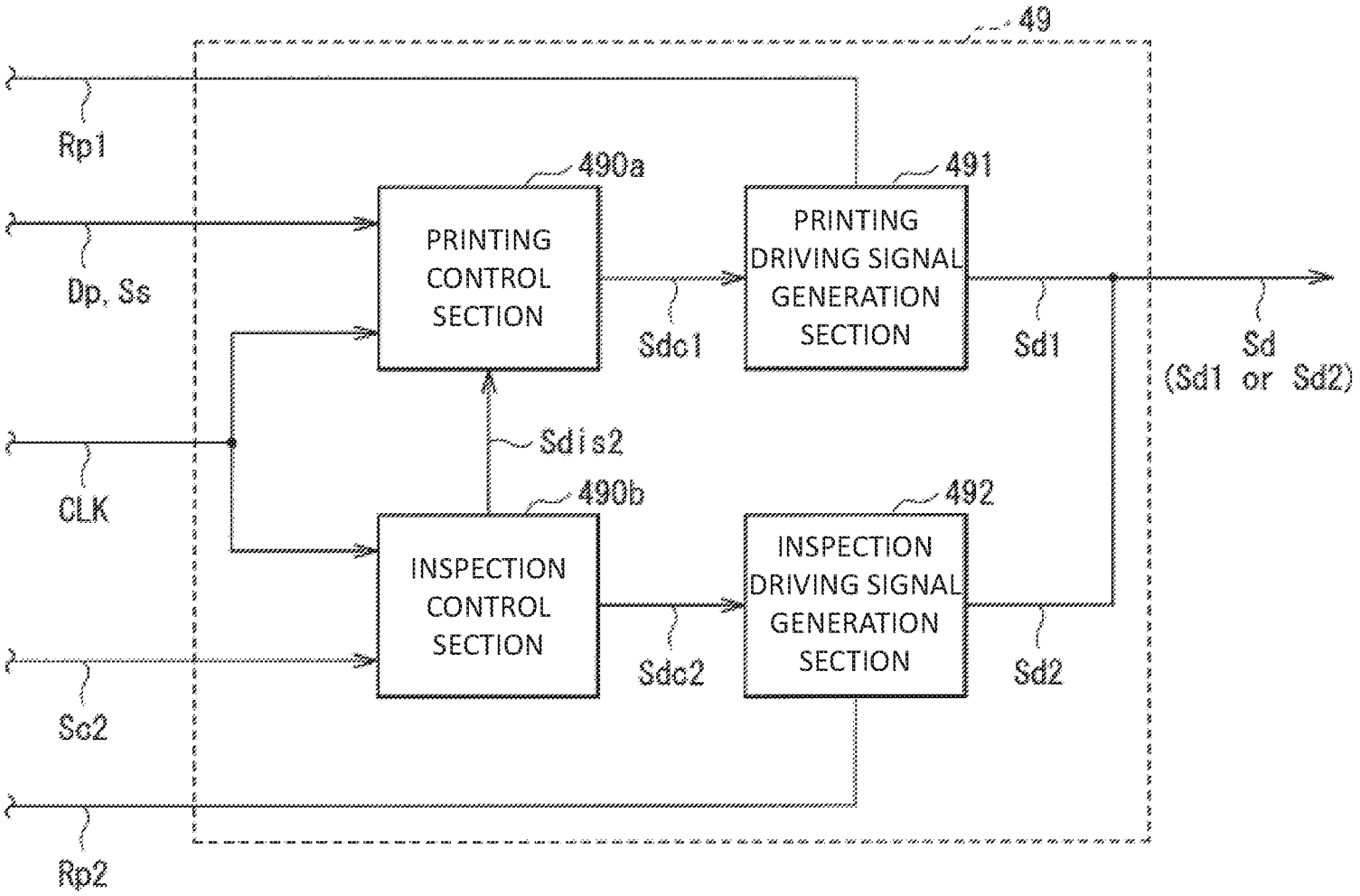
FIG. 4 is a block diagram illustrating a detailed configuration example of a driving circuit illustrated in FIG. 3.
Figure 5:
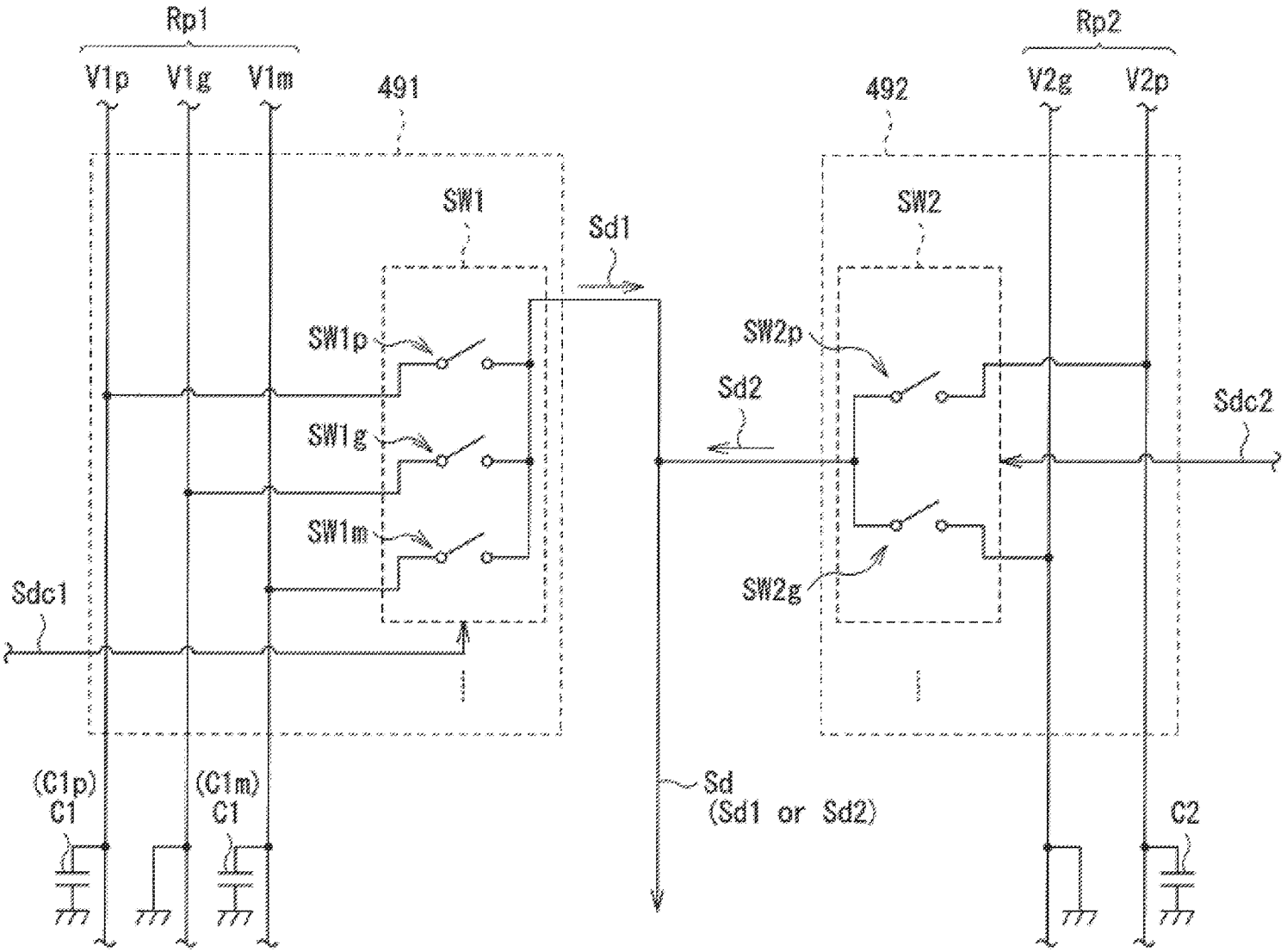
FIG. 5 is a circuit diagram illustrating a detailed configuration example of a printing driving signal generation section and an inspection driving signal generation section illustrated in FIG. 4.

A detailed configuration example of such a driving circuit 49 will be described later (FIGS. 4 and 5).

Current Detection Section 46, A/D Converter 47

As illustrated in FIG. 3, the current detection section 46 is disposed on the power supply path Rp2 and detects current consumption occurring on the power supply path Rp2 when the ejecting section (actuator plate 42 and nozzle plate 41) is driven based on the inspection driving signal Sd2 described later. Specifically, the current detection section 46 outputs a current consumption signal Sia configured from an analog signal, as a detection result of such power consumption on the power supply path Rp2. Such a current detection section 46 includes, for example, a current detection resistor element that performs current-voltage conversion, an amplifier circuit that amplifies a minute voltage generated between terminals of the resistor element, and a filter circuit that suppresses noise.

As illustrated in FIG. 3, the AD converter 47 performs analog-digital (A/D) conversion of the current consumption signal (analog signal) Sia output from the current detection section 46, so as to generate a current consumption signal Sid configured from a digital signal.

Inspection-Notification Section 48

The inspection-notification section 48 inspects the state of the above-described ejecting section based on the detection result of current consumption on the power supply path 102, which is obtained by the current detection section 46. In addition, the inspection-notification section 48 performs a notification of a result obtained by such an inspection. Specifically, the inspection-notification section 48 performs the inspection based on the current consumption signal Sid output from the A/D converter 47 and notifies the printer control section 11 on the outside of the ink jet head 40 of a result notification signal Sr as the inspection result through a serial communication line 70 (see FIG. 3). The inspection-notification section 48 outputs an inspection control signal Sc2 being a control signal when the inspection driving signal Sd2 described later is generated, to the driving circuit 49 (see FIG. 3).

Here, the inspection control signal Sc2 corresponds to a specific example of "a control signal" in the present disclosure.

As illustrated in FIG. 3, the serial communication line 70 connects the inspection-notification section 48 and the printer control section 11 to each other and is a communication line, for example, using an inter-integrated circuit ($I^2C$) communication or the like. For example, transmission and reception of, for example, the inspection result (result notification signal Sr), a start of an inspection, or the like is performed through such a serial communication line 70. The inspection control signal Sc2 is supplied to the driving circuit 49 using a communication (low-speed communication in the ink jet head 4) having a speed lower than the speed in transmission through the above-described high-speed differential transmission path. Examples of such a low-speed communication include an $I^2C$ communication and a serial peripheral interface (SPI) communication.

Here, specific examples of contents of such an inspection (inspection of the state of the ejecting section) include an inspection of the state of the nozzle plate 41, an inspection of the state of the above-described drive wall in the actuator plate 42, and an inspection of the filling state with the ink 9 in the above-described pressure chamber. As a method of such inspections, for example, it is determined whether the state of the ejecting section is normal or abnormal, by determining whether or not the value of the current consumption, which is indicated by the current consumption signal Sid is within a predetermined range. Specifically, in a case where the value of current consumption is within the predetermined range, the ejecting section is determined to be in a normal state. In a case where the value of current consumption exceeds an upper limit value of the predetermined range, it is determined that, for example, short-circuited failure occurs in the ejecting section. In a case where the value of current consumption lowers a lower limit value of the predetermined range, it is determined that, for example, an abnormal state by open failure occurs in the ejecting section.

Such an inspection-notification section (arithmetic operation section) 48 is configured using a digital arithmetic circuit such as a central processing unit (CPU), a field-programmable gate array (FPGA), and a digital signal processor (DSP), for example.

C. Detailed Configuration of Driving Circuit 49

A detailed configuration example of the driving circuit 49 will be described with reference to FIGS. 4 and 5. FIG. 4 is a block diagram illustrating the detailed configuration example of the driving circuit 49.

As illustrated in FIG. 4, the driving circuit 49 includes a printing control section 490*a*, an inspection control section 490*b*, a printing driving signal generation section 491, and an inspection driving signal generation section 492.

The printing control section 490*a* and the inspection control section 490*b* correspond to a specific example of "the control section" in the present disclosure. The printing driving signal generation section 491 corresponds to a specific example of "a first signal generation section" in the present disclosure. The inspection driving signal generation section 492 corresponds to a specific example of "a second signal generation section" in the present disclosure.

The printing control section 490*a* generates a printing drive control signal Sdc1 based on a predetermined control clock UK, the print data Dp and the discharge start signal Ss described above, and a print control disable signal Sd1*s*2 output from the inspection control section 490*b*. The printing drive control signal Sdc1 is a signal for controlling an operation (operation of generating the printing driving signal Sd1) of the printing driving signal generation section 491 described later. The control clock CLK is a clock signal (see FIG. 3) which is generated in the ink jet head 4 and is input to the driving circuit 49. Although details will be described later, the print control disable signal Sd1*s*2 is a disable signal for restricting an operation of the printing control section 490*a* (prohibiting generation of the printing driving signal Sd1).

The inspection control section 490*b* generates an inspection drive control signal Sdc2 based on the control clock CLK and an inspection control signal Sc2 obtained by the above-described low-speed communication. The inspection drive control signal Sdc2 is a signal for controlling an operation (operation of generating the inspection driving signal Sd2) of the inspection driving signal generation section 492 described later. The inspection control section 490*b* also generates the print control disable signal Sd1*s*2 and outputs the generated print control disable signal Sd1*s*2 to the printing control section 490*a*.

Although details will be described later, such a printing control section 490*a* and an inspection control section 490*b* controls the printing driving signal generation section 491 and the inspection driving signal generation section 492 so as to exclusively output one of the printing driving signal Sd1 and the inspection driving signal Sd2. That is, as illustrated in FIG. 4, one of the printing driving signal Sd1 and the inspection driving signal Sd2 is output to the ejecting section (actuator plate 42 and nozzle plate 41) from the driving circuit 49, as a driving signal Sd (see FIG. 3).

Printing Driving Signal Generation Section 491, Inspection Driving Signal Generation Section 492

The printing driving signal generation section 491 is connected to the above-described power supply path Rp1 and generates the printing driving signal Sd1 for ejecting the ink 9 from the nozzle hole Hn based on a predetermined power supply voltage supplied from the power supply path Rp1 and the printing drive control signal Sdc1. Such a printing driving signal generation section 491 is configured using a transistor circuit group described later (see FIG. 5).

The inspection driving signal generation section 492 is connected to the above-described power supply path Rp1, and generates the inspection driving signal Sd2 for performing the above-described inspection, based on a predetermined power supply voltage supplied from the power supply path Rp1 and the inspection drive control signal Sdc2. Such an inspection driving signal generation section 492 is also configured using the transistor circuit group described later (see FIG. 5).

Here, power consumption P492 in such an inspection driving signal generation section 492 is smaller than power consumption P491 in the printing driving signal generation section 491 (power consumption P491>power consumption P492).

Figures 8A, 8B, 8C, 8D:
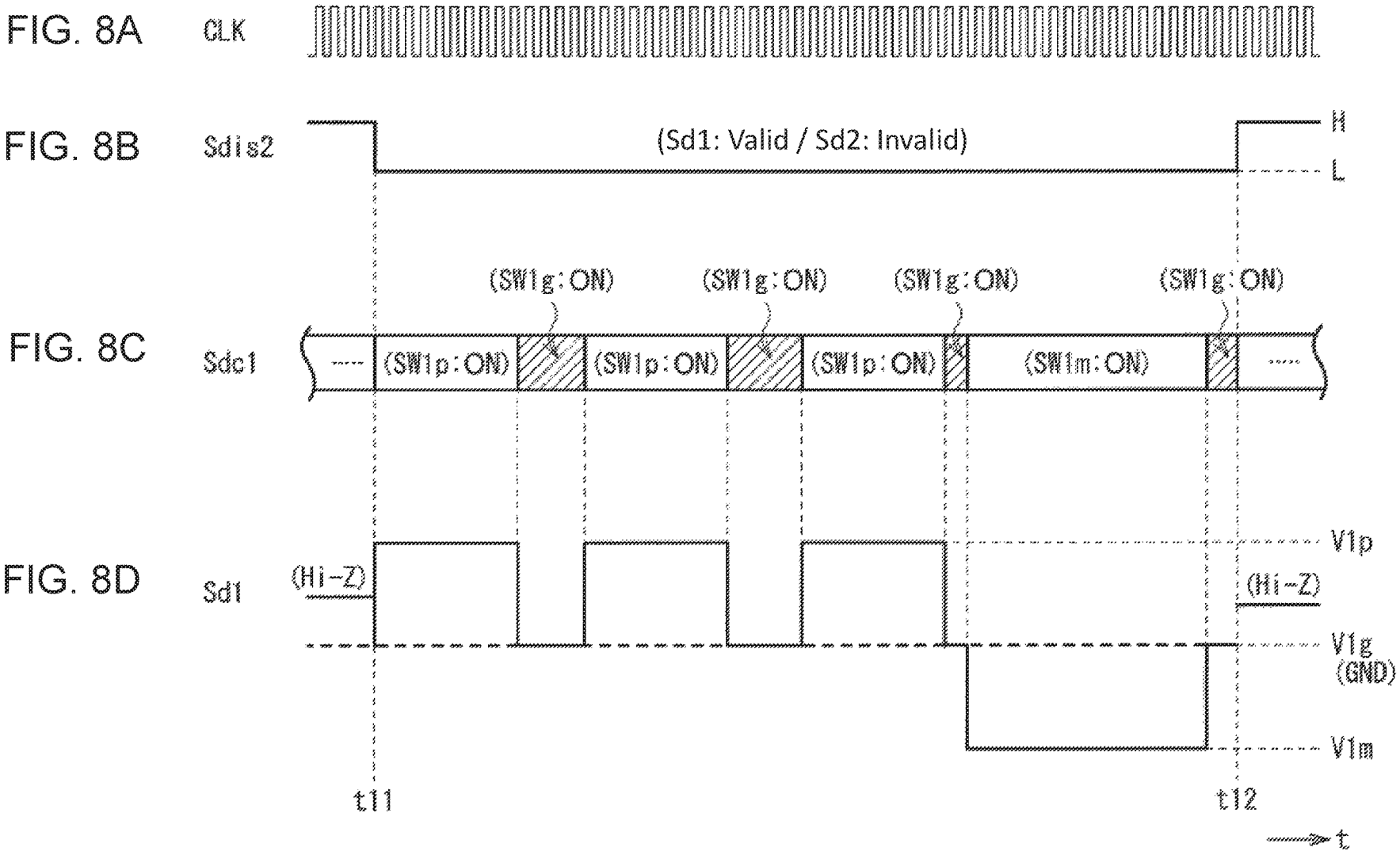
FIGS. 8A, 8B, 8C and 8D are schematic timing charts illustrating a generation processing example of the printing driving signal according to the embodiment.
Figures 9A, 9B, 9C, 9D, 9E:
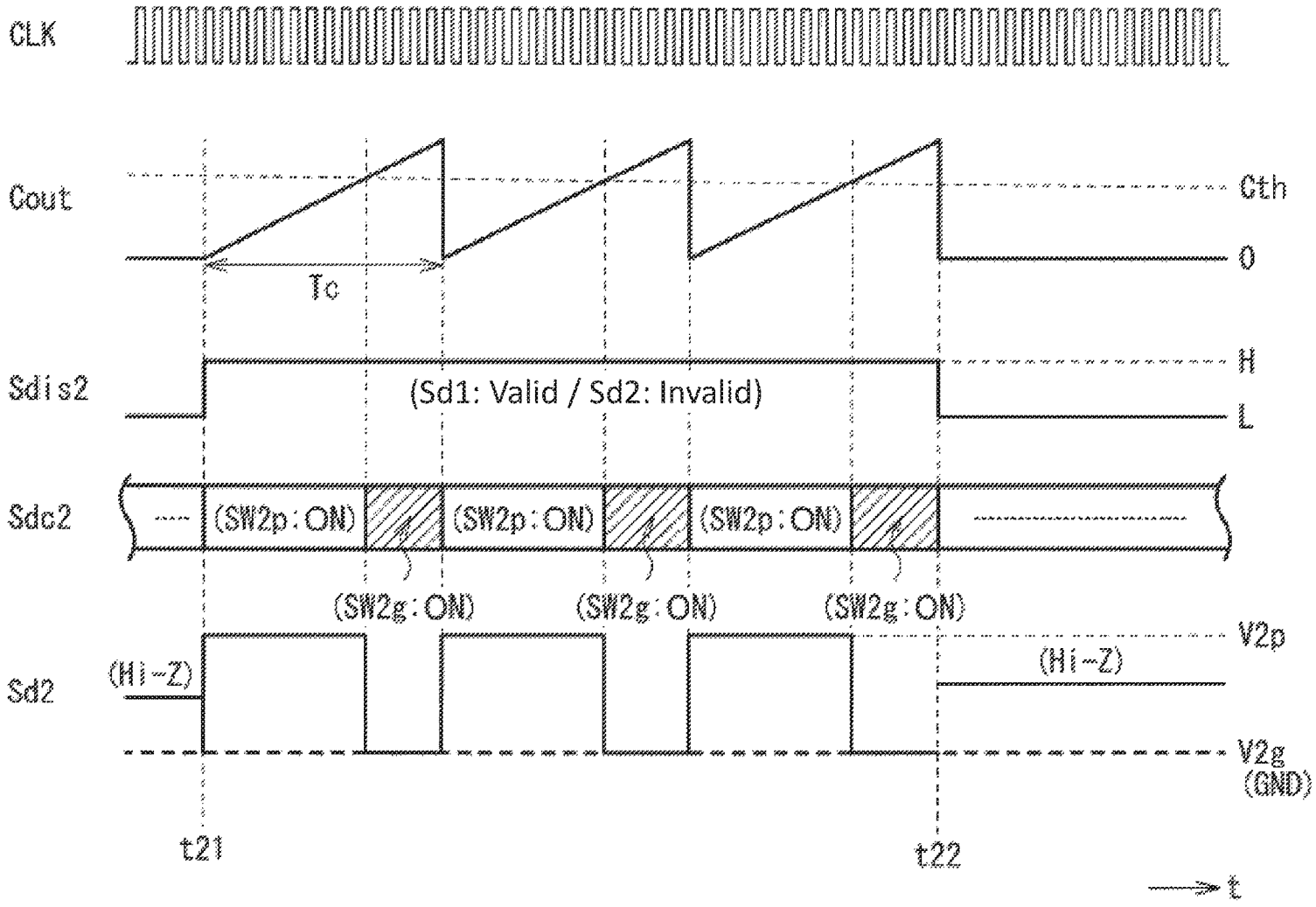
FIGS. 9A, 9B, 9C, 9D and 9E are schematic timing charts illustrating a generation processing example of the inspection driving signal according to the embodiment.

Details of generation processing of such a printing driving signal Sd1 and an inspection driving signal Sd2 will be described later (FIGS. 8D and 9E).

Here, a detailed configuration example of such a printing driving signal generation section 491 and an inspection driving signal generation section 492 will be described with reference to FIG. 5. FIG. 5 is a circuit diagram illustrating the detailed configuration example of the printing driving signal generation section 491 and the inspection driving signal generation section 492.

In the example illustrated in FIG. 5, three types of power supply voltages V1*p* (positive voltage), Vim (negative voltage), and V1*g* (ground voltage: GND) are supplied to the printing driving signal generation section 491 through the power supply path Rp1. Bypass capacitors C1*p* and C1*m* as the above-described bypass capacitor C1 are connected to power supply paths of the power supply voltages V1*p* and V1*m*, respectively. The power supply path of the power supply voltage V1*g* is connected to the ground (grounded).

Similarly, two types of power supply voltages V2*p* (positive voltage) and V2*g* (ground voltage) are supplied to the inspection driving signal generation section 492 through the power supply path Rp2. The above-described bypass capacitor C2 is connected to the power supply path of the power supply voltage V2*p*. The power supply path of the power supply voltage V2*g* is connected to the ground.

Here, a switch SW1 including three types of analog switches (switches SW1*p*, and SW1*g*) is provided in the printing driving signal generation section 491. Each of the switches SW1*p*, SW1*m*, and SW1*g* is configured by the above-described transistor circuit group. Although details will be described later, each of the switches is set to be in an ON state (closed state) or an OFF state (open state) in accordance with the printing drive control signal Sdc1.

Similarly, a switch SW2 including two types of analog switches (switches SW2*p* and SW2*g*) is provided in the inspection driving signal generation section 492. Each of the switches SW2*p* and SW2*g* is also configured by the above-described transistor circuit group. Although details will be described later, each of the switches is set to be in the ON state or the OFF state in accordance with the inspection drive control signal Sdc2.

As illustrated in FIG. 5, in practice, the switches SW1 and SW2 are individually provided to correspond to the number of printing driving signals Sd1 or inspection driving signals Sd2 (number of the plurality of nozzle holes Hn).

Operation, and Action and Effect

A. Basic Operation of Printer 1

In the printer 1, a recording operation (printing operation) of an image, a character, or the like is performed on recording paper P in a manner as follows. As an initial state, the inks 9 having the colors (four colors) corresponding to the four types of ink tanks 3 (3Y, 3M, 3C, and 3K) illustrated in FIG. 1, respectively, are sealed by the four types of ink tanks. A state where the ink jet head 4 is filled with the ink 9 in the ink tank 3 through the ink supply tube 50 is made.

In such an initial state, if the printer 1 is operated, the grid roller 1 in each of the transport mechanisms 2*a* and 2*b* rotates, and thus the recording paper P is transported between the grid roller 21 and the pinch roller 22 in a transport direction (X-axis direction) d. Simultaneous with such a transport operation, the driving motor 633 in the driving mechanism 63 rotates the pulleys 631*a* and 631*b* to operate the endless belt 632. Thus, while the carriage 62 is guided by the guide rails 61*a* and 61*b*, the recording paper P reciprocates in the width direction (Y-axis direction). At this time, the four colors of inks 9 are appropriately discharged onto the recording paper P by the ink jet heads 4 (4Y, 4M, 4C, and 4K), and, in this manner, the recording operation of an image, a character, or the like on the recording paper P is performed.

B. Detailed Operation in Ink Jet Head 4

A detailed operation of the ink jet head 4 (ejection operation of the ink 9) will be described. That is, in the ink jet head 4, an ejection operation of the ink 9 using a shear mode is performed in a manner as follows.

Firstly, the driving circuit 49 applies a drive voltage Vd (printing driving signal Sd1 as the driving signal Sd) to the above-described driving electrode (common electrode and active electrode) in the actuator plate 42 (see FIGS. 2 and 3). Specifically, the driving circuit 49 applies the drive voltage Vd to each driving electrode disposed on a pair of drive walls that define the above-described discharge channel. Thus, each of the pair of drive walls deforms to protrude toward the dummy channel adjacent to the discharge channel.

At this time, the drive wall deforms to be bent in a V shape using an intermediate position in a depth direction of the drive wall as the center. The discharge channel is deformed to swell, by such bending deformation of the drive wall. As described above, the pair of drive wall deform to be bent by a piezoelectric thickness-shear effect, and thus the volume of the discharge channel increases. The ink 9 is guided into the discharge channel by increasing the volume of the discharge channel.

Then, the ink 9 guided into the discharge channel in this manner propagates in the discharge channel in a form of a pressure wave. The drive voltage Vd to be applied to the driving electrode becomes 0 (zero) V at a timing at which the pressure wave reaches the nozzle hole fin of the nozzle plate 41 (or reaches the vicinity of the nozzle hole Hn). Thus, the drive wall is restored from the state of bending deformation, and as a result, the volume of the discharge channel, which has increased is brought back to the original again.

In this manner, in the process of the volume of the discharge channel being brought back to the original, pressure in the discharge channel increases, and thus the ink 9 in the discharge channel is pressurized. As a result, an ink droplet 9 is discharged to the outside (toward recording paper P) through the nozzle hole (see FIGS. 2 and 3). The ejection operation (discharge operation) of the ink 9 in the ink jet head 4 is made in this manner. As a result, the recording operation (printing operation) of an image, a character, or the like on the recording paper P is performed.

C. Inspection Processing Regarding State of Ejecting Section

Figure 6:
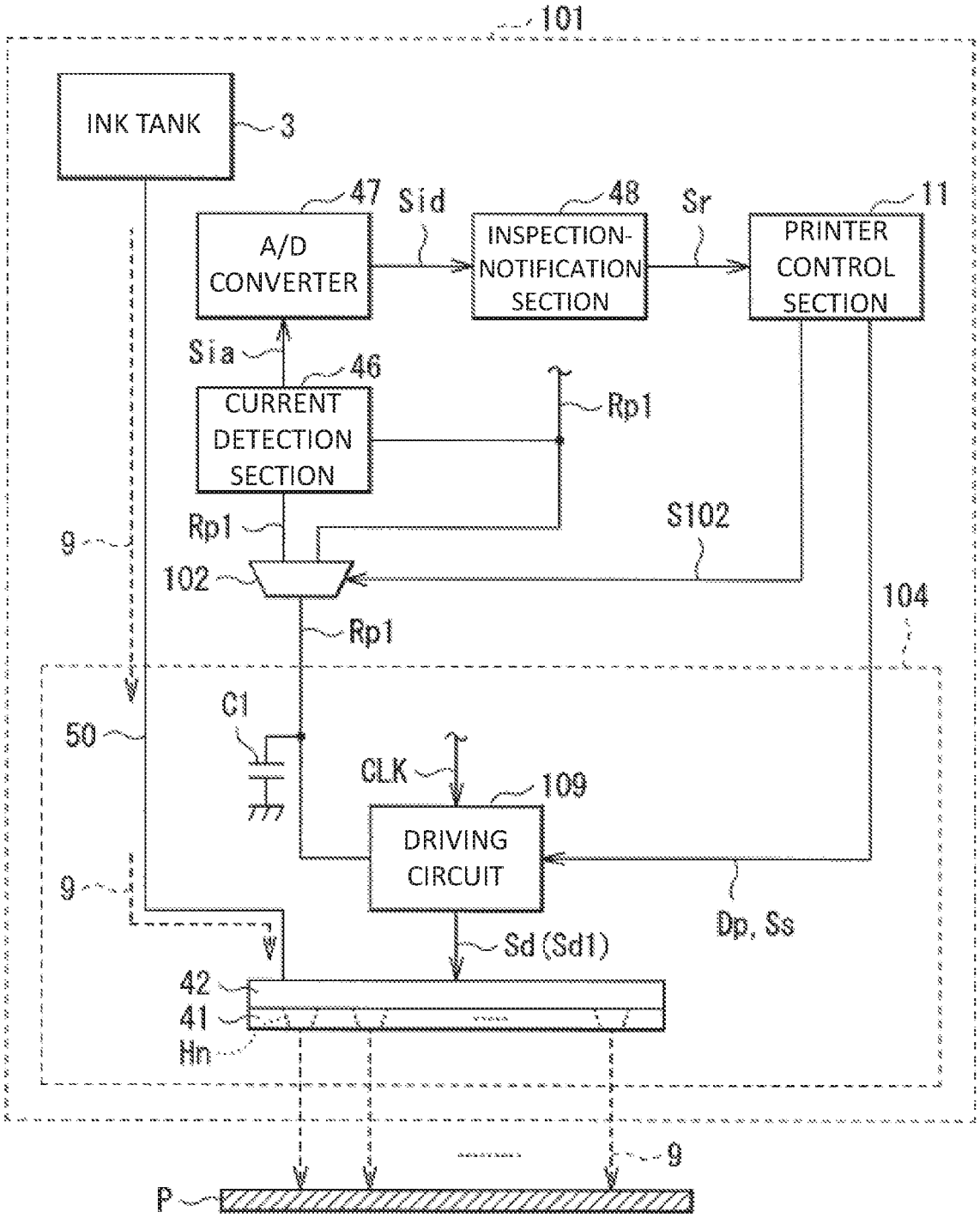
FIG. 6 is a block diagram illustrating a configuration example of a liquid-ejecting recording apparatus according to a comparative example.
Figure 7:
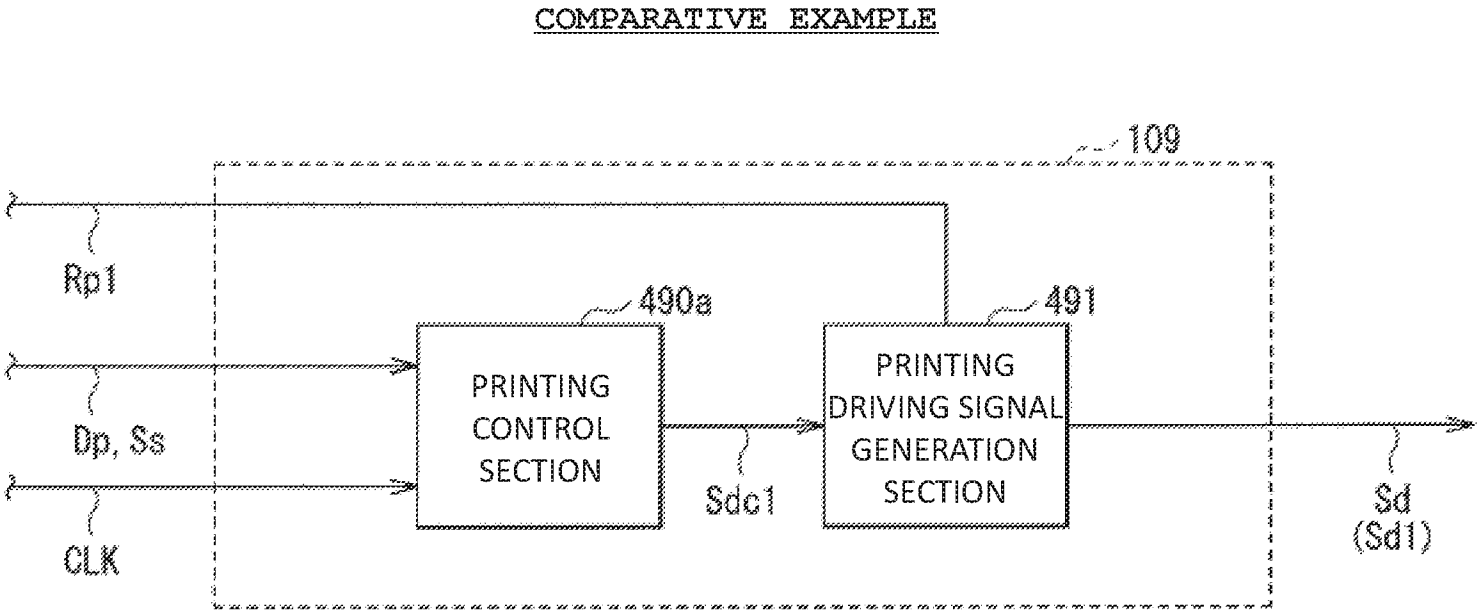
FIG. 7 is a block diagram illustrating a detailed configuration example of a driving circuit illustrated in FIG. 6.

Next, inspection processing and the like regarding the state of the above-described ejecting section will be described in detail with reference to FIGS. 1 to 5 and 6 to 9, with comparison to a comparative example (FIGS. 6 and 7).

C-1. Regarding Inspection Processing

Firstly, inspection processing and the like regarding the state of the ejecting section in a printer including a general ink jet head will be described.

Firstly, when the ink jet head is filled with an ink from the ink tank, normally, a method of performing a practical printing operation is employed in order to check whether or not all pressure chambers are filled with the ink. In this method, since the performing practical printing operation is intended, the ink, a recording medium, and the like are consumed until filling with the ink is completed.

Examples of a method of checking whether or not all pressure chambers are filled with the ink, in advance, include a method of measuring current consumption when the ejecting section is driven and determining a filling state with the ink from a measurement result of the current consumption. In the comparative example described below, determination (inspection) using such a measurement result of the current consumption is performed on the outside of the ink jet head in the printer.

C-2. Comparative Example

FIG. 6 is a block diagram illustrating a configuration example of a liquid-ejecting recording apparatus (printer 101) according to such a comparative example. FIG. 7 is a block diagram illustrating a detailed configuration example of a driving circuit (driving circuit 109 described later) in the comparative example illustrated in FIG. 6.

In the comparative example, the printer 101 is obtained by changing the printer 1 in the embodiment illustrated in FIG. 3 as follows see FIG. 6). That is, in the printer 101, an ink jet head 104 including the driving circuit 109 is provided instead of the ink jet head 4 including the driving circuit 49. The printer 101 is different from the printer 1 in that only one type of power supply path Rp1 is provided, and the above-described power supply path Rp2 is not provided. In addition, in the printer 101, the current detection section 46, the A/D converter 47, and the inspection-notification section 48 described above are provided on the outside of the ink jet head 104, and a switching section 102 using an analog switch is further provided on the outside of the ink jet head 104.

As illustrated in FIG. 7, the driving circuit 109 in the comparative example has a configuration in which the inspection control section 490*b* and the inspection driving signal generation section 492 are not provided (are omitted) in the driving circuit 49 (see FIG. 4) in the embodiment. That is, only the printing control section 490*a* and the printing driving signal generation section 491 are provided in the driving circuit 109. Thus, in the driving circuit 109, the printing driving signal Sd1 is generated using the control clock UK, the print data Dp, the discharge start signal Ss, the printing drive control signal Sdc1, and the power supply path Rp1 (predetermined power supply voltage) as described above. Then, the printing driving signal Sd1 is output as the driving signal Sd.

With such a difference in configuration and the like, the printer 101 is different from the printer 1 (see FIG. 3) in which the inspection processing and the like are performed in the ink jet head 4. In the printer 101, the inspection processing and the like are performed outside the ink jet head 104.

Specifically, in the printer 101 in the comparative example, the current consumption occurring on the power supply path Rp1 is detected by the current detection section 46 and is output as the current consumption signal (analog signal) Sia. Then, the current consumption signal (analog signal) Sia is converted into a current consumption signal (digital signal) Sid by the A/D converter 47. The inspection processing regarding the state of the ejecting section is performed by the inspection-notification section 48 based on the current consumption signal Sid, and the printer control section 11 is notified of an inspection result (result notification signal Sr), The path of the power supply path Rp1 is switched based on a switching signal S102 to be output from the printer control section 11 to the switching section 102 between the time of such inspection processing and the time of the normal printing operation. That is, during the normal printing operation, the path of the power supply path Rp1 is set not to pass through the current detection section 46. During the inspection processing, the path of the power supply path Rp1 is set to pass through the current detection section 46 (see FIG. 6).

However, for example a problem as follows may occur in the inspection processing and the like according to such a comparative example.

That is, firstly, in the comparative example, since the inspection is performed based on the detection result of the current consumption occurring on the power supply path Rp1, an integration time constant increases by the large-capacitance bypass capacitor C1 connected to the power supply path Rp1. As a result, an inspection time increases.

Since the switching section 102 is configured using the analog switch, a circuit size increases. As a result, it is difficult to reduce the size of the printer 101. Further, when current consumption is measured, for example, in a case where current consumption is performed through the resistor element which is disposed in series on the power supply path Rp1, it is required to provide a method (bypass circuit) of bypassing the resistor element, when the normal printing operation is performed. However, such addition of the bypass circuit to the power supply path Rp1 causes an increase in size of the ink jet head 104 or the printer 101.

For example, a method of generating the inspection driving signal Sd2 on the outside of the ink jet head is also considered. However, in this method, a transmission path of the inspection driving signal Sd2 to the ejecting section becomes long. Thus, in this method, the inspection time also increases, and inspection accuracy may be deteriorated by, for example, mixing noise to the inspection driving signal Sd2.

In this manner, in the comparative example and the like, since the inspection time also increases, and inspection accuracy may be deteriorated, the convenience when the state of the ejecting section is inspected is impaired.

C-3. Embodiment

In the ink jet head 4 in the embodiment, the inspection driving signal Sd2 is generated along with the printing driving signal Sd1 in the driving circuit 49 of the ink jet head 4, and one of the printing driving signal Sd1 and the inspection driving signal Sd2 is exclusively output to the ejecting section.

FIGS. 8A, 8B, 8C and 8D are timing charts schematically illustrating a generation processing example of such a printing driving signal Sd1. FIGS. 9A, 9B, 9C, 9D and 9E are timing charts schematically illustrating a generation processing example of the inspection driving signal Sd2.

FIG. 8A illustrates the above-described control clock CLK, FIG. 8B illustrates the above-described print control disable signal Sdis2, FIG. 8C illustrates the above-described printing drive control signal Sdc1, and FIG. 8D illustrates the above-described printing driving signal Sd1. FIG. 9A illustrates the control clock CLK, FIG. 9B illustrates a count value Cout which is generated by a predetermined counter and is used for forming a waveform, FIG. 9C illustrates the print control disable signal Sdis2, FIG. 9D illustrates the above-described inspection drive control signal Sdc2, and FIG. 9E illustrates the inspection driving signal Sd2. In FIGS. 8A-8D and 9A-9E, a horizontal axis indicates a time t.

Generation Processing of Printing Driving Signal Sd1

Firstly, in the generation processing example of the printing driving signal Sd1 illustrated in FIG. 8D, the printing driving signal Sd1 is generated in a manner as follows.

Firstly, in a period in which the print control disable signal Sdis2 is in a "low (L)" state (in the example in FIG. 8B, a period of timings t11 and t12), generation processing of the printing driving signal Sd1 is valid (generation processing of the inspection driving signal Sd2 is invalid).

In the period of the timings t11 and t12, the above-described three types of analog switches (switches SW1*p*, SW1*m*, and SW1*g*: see FIG. 5) are in the ON state. Thus, the corresponding power supply voltage from the power supply path Rp1 appears as a potential of the printing driving signal Sd1. Specifically, in a period in which the printing drive control signal Sdc1 is a signal for setting the switch SW1*p* to be in the ON state and setting the switches SW1*m* and SW1*g* to be in the OFF state, the power supply voltage (positive voltage) V1*p* appears as a potential of the printing driving signal Sd1. In a period in which the printing drive control signal Sdc1 is a signal for setting the switch SW1*m* to be in the ON state and setting the switches SW1*p* and SW1*g* to be in the OFF state, the power supply voltage (negative voltage) Vim appears as a potential of the printing driving signal Sd1. In a period in which the printing drive control signal Sdc1 is a signal for setting the switch SW1*g* to be in the ON state and setting the switches SW1*p* and SW1*m* to be in the OFF state, the power supply voltage (ground voltage: GND) V1*g* appears as a potential of the printing driving signal Sd1.

Such a printing drive control signal Sdc1 is generated, for example, based on a waveform setting having a length and value (LV) structure. Specifically, for example, in a case where L is set to 80, and V indicates SW1*p*, the switch SW1*p* is set to be in the ON state for a period of 80 clocks in the control clock CLK.

In this manner, the power supply voltages V1*p*, V1*m*, and V1*g* supplied from the power supply path Rp1 appear as the potentials of the printing driving signal Sd1, and thus, for example, the printing driving signal Sd1 as illustrated in FIG. 8D is generated. The printing driving signal Sd1 is configured using three types of potentials being the positive voltage (V1*p*), the negative voltage (Vim), and the ground voltage (V1*g*: GND), and thus has a complicated waveform.

In a period in which the print control disable signal Sdis2 is in a "high (H)" state, generation processing of the printing driving signal Sd1 is invalid (generation processing of the inspection driving signal Sd2 is valid), and thus an effect as follows is obtained. That is, in this period, since all the three types of analog switches (switches SW1*p*, SW1*m*, and SW1*g*) are set to be in the OFF state, the printing driving signal Sd1 is in a high impedance (Hi-Z) state (see FIG. 8D).

Generation Processing of Inspection Driving Signal Sd2

In the generation processing example of the inspection driving signal Sd2 illustrated in FIG. 9E, the inspection driving signal Sd2 is generated in a manner as follows.

For example, if an instruction to start an inspection by a communication signal from the printer control section 11 through the serial communication line 70 or an instruction to start an inspection, such as a power-on reset in the printer 1 is received, the generation processing of such an inspection driving signal Sd2 is started. Specifically, if the inspection-notification section 48 in the ink jet head 4 outputs the inspection control signal Sc2 to the driving circuit 49, the generation processing of the inspection driving signal Sd2 is started.

In the period in which the print control disable signal Sdis2 is in a "H" state (in the example in FIG. 9C, a period of timings t21 and t22), generation processing of the inspection driving signal Sd2 is valid (generation processing of the printing driving signal Sd1 is invalid).

Here, in such a period in which the print control disable signal Sdis2 is in the "H" state, the inspection drive control signal Sdc2 is generated in accordance with the magnitude relationship between the count value Cout generated by the predetermined counter based on the control clock CLK and a counter threshold value Cth. Specifically, firstly, as illustrated in FIG. 9D, the count value Cout has a counter period Tc defined by the inspection control signal Sc2. In a period in which the count value Cout is smaller than the counter threshold value Cth (Cout<Cth), the inspection drive control signal Sdc2 is a signal for setting the switch SW2*p* to be in the ON state and setting the switch SW2*g* to be in the OFF state. In a period in which the count value Cout is equal to or greater than the counter threshold value Cth (Cout≥Cth), the inspection drive control signal Sdc2 is a signal for setting the switch SW2*p* to be in the OFF state and setting the switch SW2*g* to be in the ON state.

In this manner, in the period of the timings t21 and t22, the above-described two types of analog switches (switches SW2*p* and SW2*g*: see FIG. 5) are in the ON state. Thus, the corresponding power supply voltage from the power supply path Rp2 appears as a potential of the inspection driving signal Sd2. Specifically, as described above, in a period in which the inspection drive control signal Sdc2 is a signal for setting the switch SW2*p* to be in the ON state and setting the switch SW2*g* to be in the OFF state, the power supply voltage (positive voltage) V2*p* appears as a potential of the inspection driving signal Sd2. As described above, in a period in which the inspection drive control signal Sdc2 is a signal for setting the switch SW2*g* to be in the ON state and setting the switch SW2*p* to be in the OFF state, the power supply voltage (ground voltage: GND) V2*g* appears as a potential of the inspection driving signal Sd2.

In this manner, the power supply voltages V2*p* and V2*g* to be supplied from the power supply path Rp2 appear as the potentials of the inspection driving signal Sd2, and thus, for example, the inspection driving signal Sd2 as illustrated in FIG. 9E is generated. The inspection driving signal Sd2 is configured using two types of potentials being the positive voltage (V2*p*) and the ground voltage (V2*g*: GND), and thus has a waveform in which the two types of potentials are simply repeated. That is, the inspection driving signal Sd2 has a waveform simpler than the waveform of the printing driving signal Sd1. Therefore, the inspection control signal Sc2 becomes a signal much simpler than, for example, the print data Dp and the like, and thus may be transmitted in a low transmission band.

In a period in which the print control disable signal Sdis2 is in the "L" state, generation processing of the inspection driving signal Sd2 is invalid (generation processing of the printing driving signal Sd1 is valid), and thus an effect as follows is obtained. That is, in this period, since all the two types of analog switches (switches SW2*p* and SW2*g*) are set to be in the OFF state, the inspection driving signal Sd2 is in the high impedance (Hi-L) state (see FIG. 9E).

C-4. Action and Effect

As described above, in the embodiment, the inspection driving signal Sd2 for inspecting the state of the ejecting section (actuator plate 42 and nozzle plate 41) is generated along with the printing driving signal Sd1 in the driving circuit 49 of the ink jet head 4. Thus, one of the printing driving signal Sd1 and the inspection driving signal Sd2 is exclusively output to the ejecting section. Since the ejecting section is driven based on the printing driving signal Sd1 output in this manner, the ink 9 is ejected from the nozzle hole Hn, and the ejecting section is driven based on the inspection driving signal Sd2 in the inspection.

Thus, the embodiment obtains the followings in comparison to, for example, a case where such an inspection is performed on the outside of the ink jet head 104 as in the above-described comparative example, or a case where the inspection driving signal Sd2 is generated on the outside of the ink jet head as described above. That is, the inspection time is reduced, and the transmission path of the inspection driving signal Sd2 to the ejecting section is reduced. Thus, the concern that noise or the like is mixed into the inspection driving signal Sd2 is reduced, and the inspection accuracy is improved. As a result, in the embodiment, it is possible to improve the convenience when the state of the ejecting section is inspected, in comparison to a case such as the comparative example.

Since it is possible to perform an inspection using the inspection driving signal Sd2 (see FIG. 9E) being a simple waveform signal without using the printing driving signal Sd1 (see FIG. 8D) being a complicated waveform signal, it is possible to perform the inspection by a simple control. Further, the transistor circuit group (see FIG. 5) constituting the switch SW2 in the inspection driving signal generation section 492 is used when the inspection driving signal Sd2 having such a simple waveform is generated. Thus, an effect as follows is obtained. That is, for example, even in a case where an on-resistance value of each transistor in the transistor circuit group is high (in a case where the channel area of the transistor is small), it is possible to secure sufficient performance for an inspection. Thus, the transistor circuit group having a very small circuit size is obtained. Thus, it is possible to realize the switch SW2 in the inspection driving signal generation section 492 with an area smaller than the area of the switch SW1 requiring a large area in the printing driving signal generation section 491. Further, in the printer 1 (printer control section 11), it is possible to recognize a poor state (inspection result of an abnormal state) of the (individual) ink jet head 4, and thus to determine whether or not a normal printing operation is possible. In addition, differing from the case of the above-described comparative example and the like, the switching section 102 or the bypass circuit is not required. Thus, it is possible to reduce the size of the ink jet head 4 or the printer 1.

In the embodiment, the power consumption P492 in the inspection driving signal generation section 492 is smaller than the power consumption P491 in the printing driving signal generation section 491, and thus an effect as follows is obtained. That is, the power consumption (power consumption P492) when the inspection driving signal Sd2 is generated is smaller than the power consumption (power consumption P491) when the printing driving signal Sd1 is generated. As a result, for example, the increase of the inspection time, which is caused by increasing the integration time constant due to the large-capacitance bypass capacitor C1, as described above, is avoided. Thus, it is possible to further improve the convenience when the inspection is performed.

Further, in the embodiment, the power supply path Rp1 used when the printing driving signal Sd1 is generated and the power supply path Rp1 used when the inspection driving signal Sd2 is generated are electrically isolated from each other, and thus an effect as follows is obtained. That is, since the concern of mixture and the like of the noise into the inspection driving signal Sd2 is further reduced, the inspection accuracy is further improved. For example, as in the above-described comparative example, in a case where an inspection is performed using the power supply path Rp1 (based on the detection result of the current consumption occurring on the power supply path Rp1), as described above, the integration time constant increases by the large-capacitance bypass capacitor C1, and thus the inspection time increases. On the contrary, in the embodiment, since the power supply path 102 connected to a small-capacitance bypass capacitor C2 is used (the detection result of current consumption on the power supply path Rp2 is used), the integration time constant is smaller than the integration time constant in such a comparative example. As a result, the inspection time is further reduced. Therefore, it is possible to further improve the convenience when the inspection is performed.

In addition, in the embodiment, the inspection is performed based on the detection result of the current consumption occurring on the power supply path Rp1 when the ejecting section drives based on the inspection driving signal Sd2, and a notification of a result (result notification signal Sr) of the inspection is performed. Thus, an effect as follows is obtained. That is, it is possible to cause a user to easily recognize a result (state of the ejecting section) of such an inspection. Specifically, for example, it is not necessary that a difference in an inspection method and the like by the parameter which is required in such an inspection and is unique to the ink jet head 4 is recognized in advance on the upstream side (printer control section 11) of the ink jet head 4 (for example, it is not necessary to input such a parameter in advance). Examples of the unique parameter include a difference in a structure by the type, the model number, and the like of the ink jet head 4 and a difference by an individual difference in the ink jet head 4. Examples of the difference in the inspection method and the like include a difference in the above-described predetermined range (range of current consumption for determining whether the state of the ejecting section is normal or abnormal). Therefore, in the embodiment, it is possible to furthermore improve the convenience when the inspection is performed.

In the embodiment, since the printing driving signal Sd1 is generated based on the transmission data through the above-described high-speed differential transmission path, high-speed printing performance is secured, and the generation operation of the inspection driving signal Sd2 is controlled based on the above-described inspection control signal Sc2 obtained by the low-speed communication. Thus, an effect as follows is obtained. That is, a wiring (interface such as a cable) constituting the high-speed differential transmission path is generally expensive, and such expensive wiring is not necessary for the inspection. Thus, it is possible to reduce cost required for an inspection.

2. Modification Example

Hitherto, the present disclosure is described with the embodiment, but the present disclosure is not limited to the above embodiment, and various modifications may be made.

For example, in the embodiment, the configuration example (shape, arrangement, the number of pieces, and the like) of the members in the printer and the ink jet head is specifically described using the example. However, the present disclosure is not limited to the above-described embodiment, and members having another shape, arrangement, the number of pieces, and the like may be provided. Specifically, for example, in the ink jet head, a plurality of driving sections (driving circuits) may be cascade-connected (multistage-connected) or may be multi-drop connected to each other. The specific block configuration in the driving circuit 49 and the specific circuit configurations in the printing driving signal generation section 491 and the inspection driving signal generation section 492 are not limited to the above-described embodiment, and other block configurations, circuit configurations, and the like may be provided. Further, in the embodiment, a case were the transmission data transmitted from the outside of the ink jet head to the inside thereof is data transmitted through the high-speed differential transmission path is described as an example. However, the present disclosure is not limited to this example. For example, the transmission data may not be data transmitted through the high-speed differential transmission path. In addition, in the embodiment, a case where the transmission data is transmitted in a manner of LVDS is described as an example. However, the present disclosure is not limited to this example. For example, the transmission data may be transmitted using a physical layer in, for example, an emitter coupled logic (ECL) or a current mode logic (CML). In data transmission, for example, an embedded clock method in which the clock signal may not be transmitted, and data transmission is performed by incorporating a clock signal into a data line may be used.

Various types may be applied as the structure of the ink jet head. That is, for example, a so-called side shoot type of ink jet head that discharges the ink 9 from the central portion of the actuator plate in an extending direction of each discharge channel may be provided. Alternatively, for example, a so-called edge shoot type of ink jet head that discharges the ink 9 in the extending direction of each discharge channel may be provided. Further, the printer method is not limited to the method described in the above embodiment, and various methods such as a thermal method (thermal method on demand type) and a micro electro mechanical systems (MEMS) can be applied, for example.

Further, in the embodiment, a non-circulation type of ink jet head that uses the ink 9 without being circulated between the ink tank and the ink jet head is described as an example. However, the present disclosure is not limited to this example. That is, for example, the present disclosure can also be applied to a circulation type of ink jet head that circulates and uses the ink 9 between the ink tank and the ink jet head.

In addition, in the embodiment, the inspection processing method regarding the ejecting section is specifically described. However, the method is not limited to the example described in the embodiment, and other methods may be provided.

The series of processes described in the embodiment may be performed by hardware (circuit) or may be performed by software (program). When the processes are performed by software, the software is configured by a group of programs for causing a computer to perform functions. Each program may be used by being incorporated in the computer in advance, or may be used by being installed on the computer from a network or a recording medium.

Furthermore, in the embodiment, the printer (ink jet printer) 1 is described as a specific example of the "liquid-ejecting recording apparatus" in the present disclosure. However, the present disclosure is not limited to this example, and the present disclosure can be applied to apparatuses other than the ink jet printer. In other words, the "liquid ejecting head" (ink jet head) in the present disclosure may be applied to apparatuses other than the ink jet printer. Specifically, for example, the "liquid ejecting head" in the present disclosure may be applied to a device such as a facsimile or an on-demand printing machine.

In addition, the various examples described here may be applied in any combination.

In addition, the effect described in this specification is just an example and is not limited. Other effects may be obtained.

The present disclosure may have configurations as follows.

<1> A driving circuit for ejecting a liquid from a plurality of nozzles in an ejecting section in a liquid ejecting head, the driving circuit comprising: a first signal generation section that generates a printing driving signal for ejecting the liquid from the nozzles; a second signal generation section that generates an inspection driving signal for inspecting a state of the ejecting section; and a control section that controls the first signal generation section and the second signal generation section so as to exclusively output one of the printing driving signal and the inspection driving signal to the ejecting section.

<2> The driving circuit according to <1>, wherein power consumption in the second signal generation section is smaller than power consumption in the first signal generation section.

<3> A liquid ejecting head comprising: the driving circuit according to <1> or <2>; and the ejecting section including the plurality of nozzles, wherein the driving circuit drives the ejecting section based on the printing driving signal so as to eject the liquid from the nozzles, and drives the ejecting section based on the inspection driving signal in an inspection of the state of the ejecting section.

<4> The liquid ejecting head according to <3>, further comprising: a first power supply path which is connected to the first signal generation section and is used for generating the printing driving signal; and a second power supply path which is electrically isolated from the first power supply path, is connected to the second signal generation section, and is used for generating the inspection driving signal.

<5> The liquid ejecting head according to <4>, further comprising: a current detection section that detects current consumption occurring on the second power supply path when the ejecting section is driven based on the inspection driving signal; an inspection section that inspects the state of the ejecting section based on a detection result of the current consumption in the current detection section; and a notification section that notifies an inspection result of the state of the ejecting section by the inspection section.

<6> The liquid ejecting head according to any one of <3> to <5>, wherein the first signal generation section generates the printing driving signal based on transmission data transmitted from an outside of the liquid ejecting head through a high-speed differential transmission path, the control section controls an operation of generating the inspection driving signal in the second signal generation section, based on a control signal obtained by a low-speed communication in the liquid ejecting head, which is a communication slower than transmission through the high-speed differential transmission path.

<7> A liquid-ejecting recording apparatus comprising the liquid ejecting head according to any one of <3> to <6>.

What is claimed is:

1. A liquid ejecting head comprising:

a driving circuit for ejecting a liquid from a plurality of nozzles in an ejecting section in a liquid ejecting head, the driving circuit comprising:

a first signal generation section that generates a printing driving signal for ejecting the liquid from the nozzles;

a second signal generation section that generates an inspection driving signal for inspecting a state of the ejecting section; and a control section that controls the first signal generation section and the second signal generation section so as to exclusively output one of the printing driving signal and the inspection driving signal to the ejecting section, wherein power consumption in the second signal generation section is smaller than power consumption in the first signal generation section, wherein the ejecting section includes the plurality of nozzles, and wherein the driving circuit drives the ejecting section based on the printing driving signal so as to eject the liquid from the nozzles, and drives the ejecting section based on the inspection driving signal in an inspection of the state of the ejecting section;

a first power supply path which is connected to the first signal generation section and is used for generating the printing driving signal; and a second power supply path which is electrically isolated from the first power supply path, is connected to the second signal generation section, and is used for generating the inspection driving signal.

2. The liquid ejecting head according to claim 1, further comprising:

a current detection section that detects current consumption occurring on the second power supply path when the ejecting section is driven based on the inspection driving signal;

an inspection section that inspects the state of the ejecting section based on a detection result of the current consumption in the current detection section; and a notification section that notifies an inspection result of the state of the ejecting section by the inspection section.

3. The liquid ejecting head according to claim 1, wherein the first signal generation section generates the printing driving signal based on transmission data transmitted from an outside of the liquid ejecting head through a high-speed differential transmission path, the control section controls an operation of generating the inspection driving signal in the second signal generation section, based on a control signal obtained by a low-speed communication in the liquid ejecting head, which is a communication slower than transmission through the high-speed differential transmission path.

4. A liquid-ejecting recording apparatus comprising the liquid ejecting head according to claim 1.

* * * * *